US009551165B2

(12) United States Patent
Piron

(10) Patent No.: US 9,551,165 B2
(45) Date of Patent: Jan. 24, 2017

(54) MAGNETIC KEY AND LOCKING SYSTEM

(71) Applicant: PINEL MEDICAL INC., Kitchener (CA)

(72) Inventor: Ludwig Piron, Kitchener (CA)

(73) Assignee: Pinel Medical Inc., Kitchener (CA)

( * ) Notice: Subject to any disclaimer, the term of this patent is extended or adjusted under 35 U.S.C. 154(b) by 0 days.

(21) Appl. No.: 15/164,206

(22) Filed: May 25, 2016

(65) Prior Publication Data

US 2016/0326776 A1 Nov. 10, 2016

Related U.S. Application Data

(63) Continuation of application No. 14/565,810, filed on Dec. 10, 2014, now Pat. No. 9,371,668, which is a continuation of application No. 12/821,642, filed on Jun. 23, 2010, now abandoned.

(60) Provisional application No. 61/219,572, filed on Jun. 23, 2009.

(51) Int. Cl.

| | |
|---|---|
| ***E05B 47/00*** | (2006.01) |
| ***E05B 15/16*** | (2006.01) |
| ***E05B 19/00*** | (2006.01) |

(52) U.S. Cl.

CPC ..... *E05B 47/0045* (2013.01); *E05B 15/1635* (2013.01); *E05B 19/00* (2013.01); *Y10T 70/7057* (2015.04)

(58) Field of Classification Search

CPC ..... Y10T 70/7904; Y10T 70/7057; Y10T 292/11; Y10T 70/8432; G07C 9/00174; H01F 27/365; E05B 47/0045; E05B 19/00; E05B 47/0038; E05B 15/1635; A41F 1/00

USPC ..... 70/413, 276, 57.1

See application file for complete search history.

(56) References Cited

U.S. PATENT DOCUMENTS

| | | | |
|---|---|---|---|
| 4,022,038 | A | 5/1977 | Miller |
| 4,228,667 | A | 10/1980 | Herriott |
| 4,562,711 | A | 1/1986 | Fliege |
| 4,815,304 | A | 3/1989 | Kesselman |
| 5,600,977 | A | 2/1997 | Piron |
| 6,264,284 | B1 | 7/2001 | Lees |
| 6,325,433 | B1 | 12/2001 | Nicholson et al. |
| 6,561,000 | B2 | 5/2003 | Tallarico |
| 7,621,161 | B2 | 11/2009 | Fontana et al. |
| 7,784,428 | B2 | 8/2010 | Deng |
| 8,100,598 | B2 | 1/2012 | Killion et al. |

(Continued)

FOREIGN PATENT DOCUMENTS

| | | |
|---|---|---|
| WO | 2006119961 A1 | 11/2006 |
| WO | 2006119978 | 11/2006 |
| WO | 2007025674 | 3/2007 |

OTHER PUBLICATIONS

U.S. Appl. No. 12/821,642, Office Action dated Nov. 29, 2013.

(Continued)

*Primary Examiner* — Suzanne Barrett

(74) *Attorney, Agent, or Firm* — Borden Ladner Gervais LLP; Jason R. Mueller-Neuhaus

(57) ABSTRACT

A magnetic key comprising: a body; a segmented magnet housed within the body; and a ferrous element housed above the segmented magnet. A protective cap for a magnetic key comprising a body; and a ferrous element housed within the body. A locking system comprises a magnetic key and protective cap.

15 Claims, 8 Drawing Sheets

(56) References Cited

U.S. PATENT DOCUMENTS

| | | | | |
|---|---|---|---|---|
| 8,156,628 | B2 * | 4/2012 | Roth | E05B 47/0038 24/662 |
| 9,307,797 | B2 * | 4/2016 | Sanchez | A41F 1/002 |
| 9,371,668 | B2 * | 6/2016 | Piron | E05B 19/00 |
| 2007/0113605 | A1 | 5/2007 | Lopez | |
| 2007/0159327 | A1 | 7/2007 | Belden et al. | |
| 2008/0143030 | A1 | 6/2008 | Roth | |
| 2010/0096451 | A1 | 4/2010 | Bossoney et al. | |
| 2010/0319418 | A1 | 12/2010 | Piron | |
| 2012/0055214 | A1 | 3/2012 | Nickeas et al. | |
| 2015/0191937 | A1 | 7/2015 | Piron | |

OTHER PUBLICATIONS

U.S. Appl. No. 12/821,642, Office Action dated Oct. 12, 2012.
U.S. Appl. No. 12/821,642, Office Action dated Mar. 30, 2012.
U.S. Appl. No. 12/821,642, Office Action dated Jun. 11, 2014.
U.S. Appl. No. 12/821,642, Office Action dated Mar. 26, 2013.
U.S. Appl. No. 14/565,810, Office Action dated Nov. 5, 2015.
U.S. Appl. No. 14/565,810, Notice of Allowance dated Feb. 24, 2016.
Canadian Patent Application No. 2,708,485, Office Action dated Apr. 20, 2016.

* cited by examiner

MAGNETIC KEY AND LOCKING SYSTEM

CROSS REFERENCE TO RELATED APPLICATION

This application is a continuation of U.S. patent application Ser. No. 14/565,810 filed Dec. 10, 2014, which is a continuation of U.S. patent application Ser. No. 12/821,642 filed Jun. 23, 2010, which claims the benefit of priority of U.S. Provisional Patent Application No. 61/219,572 filed Jun. 23, 2009 which are incorporated herein by reference in their entirety.

FIELD

This application relates generally to a magnetic key, more specifically this document relates to a magnetic key of the type used to unlock a locking system that includes a magnetically activated lock, such as the type that is used in restraint systems in a healthcare environment.

BACKGROUND

Magnetic keys, such as the one shown in FIG. 1A, are an integral part of a locking system used in the global healthcare environment to unlock a button or pin combination, which locks patient restraining devices. An example of such a locking system is described in U.S. Pat. No. 5,600,977 to Piron, the content of which is incorporated herein by reference.

One potential problem in a health care environment is the placement of or the carrying of an open strong magnet in an environment where stray magnetic flux lines may cause substantial and life threatening damage. Magnetic keys are typically carried by healthcare workers in a variety of ways including on a lanyard around the neck, in the pocket or on a belt. Inadvertent contact near a sensitive electronic item may destroy the item itself, could erase information contained in or on the device, or disrupt signals running along an electronic line. A pacemaker is a typical device in which a "Reed" switch could be closed by the magnetic flux. This inadvertent closing could adversely affect the proper operation of the pacemaker and could affect a patient's health.

The erasing of data could include eliminating important information from a Holter monitor to the wiping of information on an access card used to permit entry into vital areas of a hospital. Even the least severe effect of prohibited entry into such an area during an emergency could be a serious safety matter. With the increased use of medical devices in a healthcare setting relying on data carried by digital signals, a disruption of these signals by the uncontrolled flux of the magnet may continue to become more critical in the future.

SUMMARY

The embodiments described herein are intended to provide a magnetic key and key cap that reduce stray magnetic flux around the magnetic key of a magnetic activated locking device by directing flux lines downwards towards the locking device and also to reduce magnetic flux surrounding the key when not in use by providing a protective cap.

In one aspect, a magnetic key is provided, comprising: a body; a segmented magnet housed within the body; and a ferrous element housed above the segmented magnet.

In another aspect, the segmented magnet of the magnetic key may comprise between two and six segments. In a particular case, the segmented magnet may comprise between four and six segments.

In a particular case, the body of the magnetic key may comprise legs extending from the body, and the body of the magnetic key may be molded of plastic.

In a particular case, the body of the magnetic key may comprise a molded handle. The molded handle may further comprise a finger aperture.

In another particular case, the segmented magnet of the magnetic key may be ring shaped.

In another aspect, there is provided a protective cap for a magnetic key comprising: a body; and a ferrous element housed within the body.

In a particular case, the ferrous element of the protective cap may be a matching ferrous element to a ferrous element of a magnetic key. The protective cap may further comprise a filler housed within the body and above the ferrous element.

In a further aspect, a magnetic locking system is provided comprising: a magnetic key comprising: a body; a segmented magnet housed within the body; and a ferrous element housed above the segmented magnet; and a protective cap comprising a body housing a ferrous element.

In one aspect, the ferrous element of the protective cap is a matching ferrous element to the magnetic key of the locking system.

In a particular case the segmented magnet of the locking system may comprises between two and six segments. In another particular case, the segmented magnet may comprise between four and six segments.

In another particular case, the body of the magnetic key of the locking system may comprise legs extending from the body; the body and legs may be molded of plastic.

In a particular case, the body of the magnetic key of the locking system may comprise a molded handle. The molded handle may further comprise a finger aperture.

In a particular case, the protective cap of the locking system may further comprise a filler housed within the body and above the ferrous element.

In another particular case, the segmented magnet of the magnetic key of the locking system may be ring shaped.

Other aspects and features will become apparent to those ordinarily skilled in the art upon review of the following description of specific embodiments in conjunction with the accompanying figures.

BRIEF DESCRIPTION OF THE DRAWINGS

Embodiments herein will now be described, by way of example only, with reference to the attached Figures, wherein.

DETAILED DESCRIPTION OF THE DRAWINGS

Figure 2:
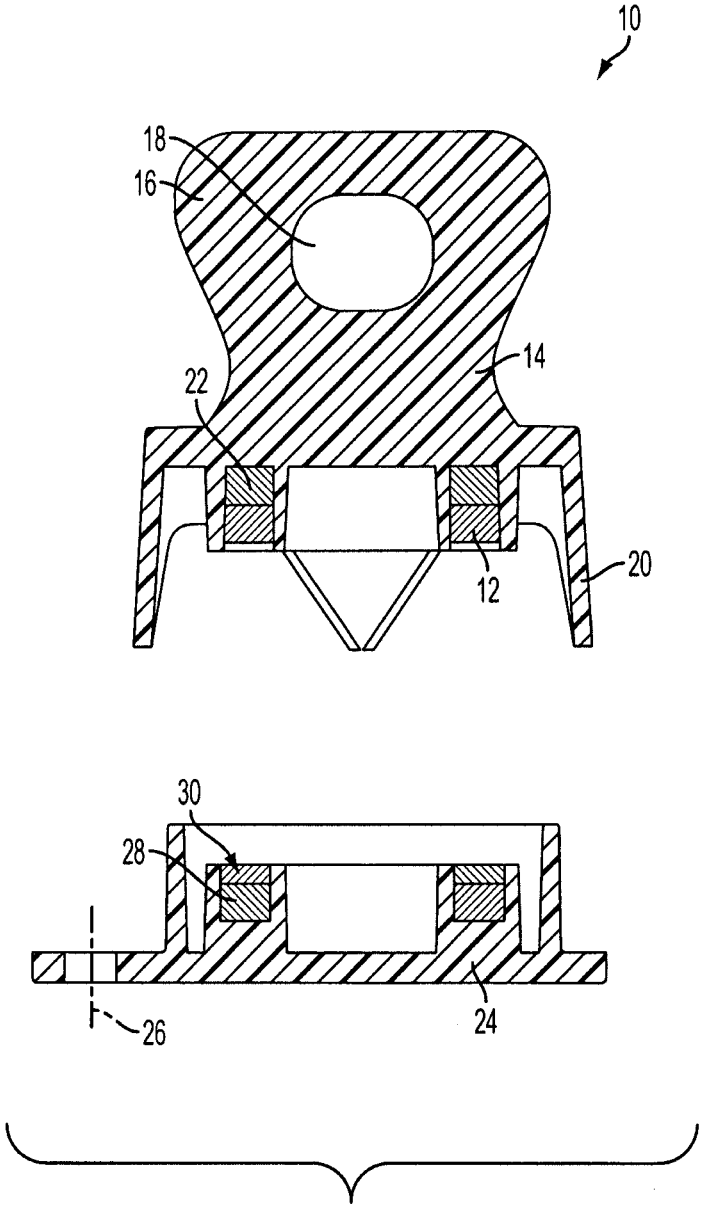
FIG. 2 illustrates a cross-sectional view of an embodiment of a magnetic key.
Figure 3:
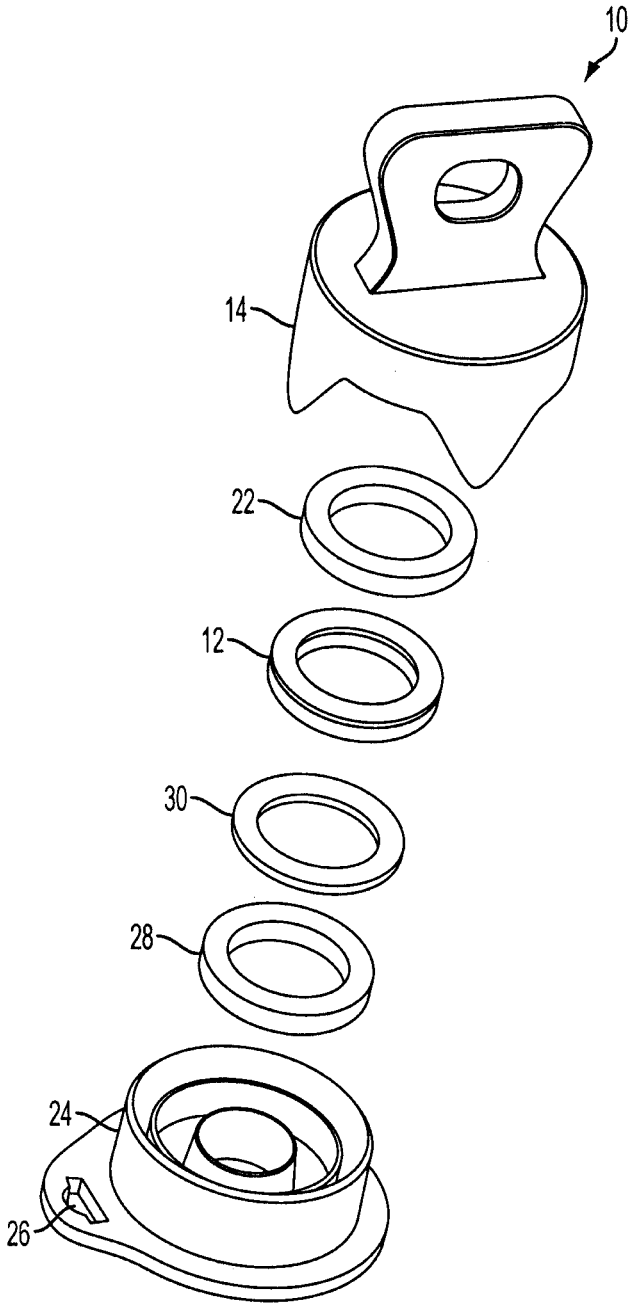
FIG. 3 illustrates an exploded view of the magnetic key.

FIGS. 2 and 3 show a magnetic key (10) in a cross-sectional and exploded view. In this embodiment, the magnetic key (10) has a cylindrical shape. A segmented magnet (12) has north/south poles segmented and embedded into a ring and is secured in the key body or key container (14). The key body (14) may be made of a plastic material and may be molded with a handle (16) with or without an aperture (18). The handle aperture (18) may allow the user a better grip on the magnetic key (10) by providing a finger hole. The key body (14) may include molded protective legs (20), extending opposite to the handle as further described below. The size and shape of the key (10) will be determined by the size of the buttons or pins (not shown) the key is intended to unlock. Alternatively, the magnetic key may have a parallelepiped or rectangular prism shape. The segmented magnet may be shaped according to the shape and of the magnetic key and will further include an aperture or hollow through the center of the segmented magnet to form a ring-like enclosure.

The segmented ring magnet (12) may have any number of segments. In one alternative, the segmented ring magnet (12) may include 2 to 6 segments. In another alternative, the segmented ring magnet may have from 4 to 6 segments. In this case, the segmented ring magnet (12) includes 4 segments. In some cases, the segmented ring magnet (12) may be nickel coated neodymium or some combination of other magnetic material. Using one ring rather than separate magnets with a different pole is intended to eliminate possible confusion in placement during assembly.

In this embodiment, the magnetic flux extending in distance from one pole to the next can be reduced substantially (by approximately half) over a simple north/south pole placement and is better illustrated in FIGS. 4A to 8B. This arrangement may result in differential magnetic strength around the perimeter of the magnetic ring. As such, the segmented ring magnet is generally selected to be strong enough to permit opening of the locking device at its strongest segment. In practical terms, this means that the active magnetic flux can be substantially contained within the protective legs (20) of the key body (14) by choosing an appropriate segmented ring magnet (12). Preferably, the protective legs (20) will extend down in regular intervals around the perimeter of the key body (14). The legs may be attached to the body as a separate piece and may not need to be subdivided and in an alternative embodiment, may be an annular ring extending from the body.

The magnetic key further comprises a ferrous element (22) above the segmented magnet (12), which is intended to prevent stray magnetic field above the magnet (i.e., towards the handle). The ferrous element may be shaped similarly to the shape of the segmented magnet, in this case a ring shape. The ferrous ring (22) may also redirect the flux lines inward and away from the outer edges of the key body (14). This design is intended to take the magnetic flux radiating above the segmented ring magnet (12) and direct it through the ferrous path, which is intended to maintain the magnetic flux inside the key body (14). In addition, the ferrous ring (22) may amplify the magnetic strength in the opposite direction and focus the magnetic flux into the active area that unlocks a corresponding magnetically locked button. This embodiment may not only shield the segmented ring magnet (12) but may also reduce the magnetic strength needed to unlock the button, which may allow for a reduction in the magnetic strength of the ring magnet (12). In some cases, it is estimated that the reduction may be approximately half of what might otherwise be required.

The combination of a segmented magnet (12) with the ferrous ring (22) and the inclusion of protective legs (20) on the key body (14) may assist with preventing the magnetic flux lines from coming into contact with sensitive equipment or materials such as access cards and the like. The segmented magnet (12) typically has approximately equal strength above and below the magnet and reduced but equal strength to the sides of the magnet (as compared with a standard magnet). The ferrous ring located above the segmented magnet is intended to focus the magnetic flux into the space of the protective legs (20). The ferrous ring may also substantially reduce the magnetic flux above the segmented magnet. The segmented magnet may reduce the distance of the flux lines from the magnet. The protective legs are intended to contain a substantial portion of the downward portion of the magnetic field.

In order to further protect the surrounding environment, a locking system is provided comprising of the magnetic key and including a protective cap or cover (24) that is intended to eliminate or reduce potentially damaging residual magnetic flux around the magnet. The protective cap may also prevent sensitive material, such as wires carrying digital information, from being inserted between the protective legs and into the active magnetic field. An aperture (26) allows the protective cap (24) with the magnetic key (10) to be attached to a convenient lanyard that can be carried around the neck, on a key ring, or in a pocket.

In the locking system, as the magnetic key (10) is held to the secured protective cap (24) by magnetic strength only, it may allow for a tight hold during normal activities and may also allow for rapid removal for instantaneous use. The cap (24) may allow the magnetic key (10) to be pulled off easily and placed onto a locking button. With conventional magnetic keys, attachment of the key on a lanyard around the neck encouraged the healthcare worker to bend forward near a patient's limb to release the restraint. If the patient was or becomes aggressive, this potentially staged a dangerous leg or first attack to the face.

Figure 6:
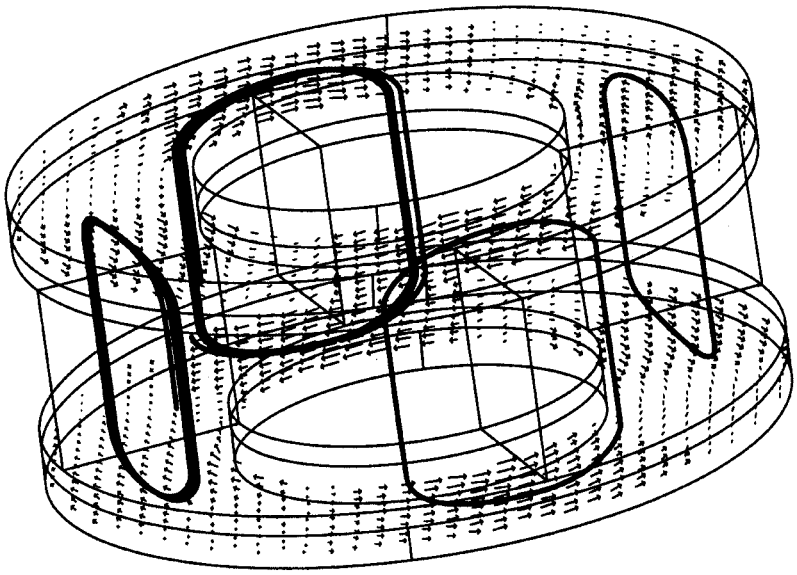
FIG. 6 illustrates flux density lines at both top and bottom ferrous rings.
Figure 8A:
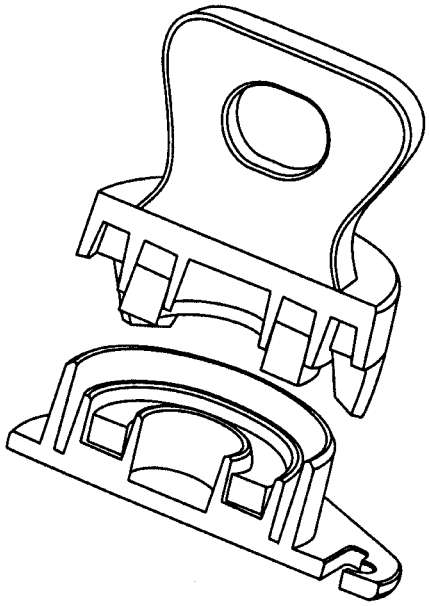
FIG. 8A illustrates a magnetic key according to another embodiment with a protective cap.
Figure 8B:
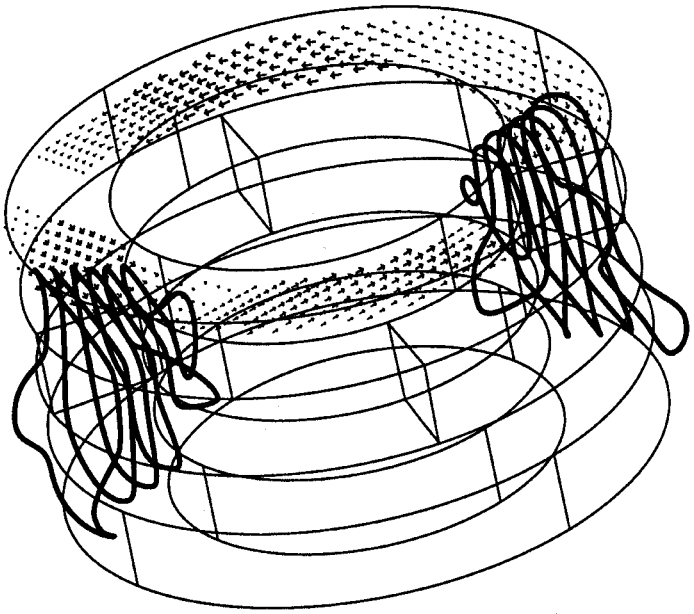
FIG. 8B illustrates the resulting magnetic flux of the magnetic key with protective cap of FIG. 8A.

The protective cap or cover (24) includes a base, which may be plastic and is sized to fit the bottom (active) portion of the magnetic key (10). Inside and centered in the protective cap (24) is a matching cap ferrous element (28), which may be, for example, flow molded into the protective cap (24) and may have a ring like structure as the ferrous element of the magnetic key. A filler (30) can cover the ferrous ring (28) to provide security and appropriate spacing between the magnet (12) and the cap ferrous ring (28) when in a closed or covered position. For example, the spacing of the filler (30) may determine the magnetic holding strength of the magnetic key (10) onto the protective cap (24). The flux lines of the magnet are directional into the protective cap and pass through the cap ferrous ring (28) inserted in the protective cap (24). The filler (30) may be any non-ferrous material, which can be preferably injection molded. In the alternative, an aluminum wash around the outside perimeter of the matching cap ferrous ring (28) may be used, but may have a substantial cost impact on the production of the protective cap. This design detours the flux lines into the cap ferrous ring (28) thereby forming a closed flux line circuit as shown in FIGS. 6 and 8B. The net result is that there should be little to no damaging stray magnetic flux around the segmented ring magnet (12), when the cap (24) is in place, in any direction, making the locking system secure even in close proximity to magnetic sensitive objects that may be found in hospitals or other healthcare environments.

When fitted, the protective cap (24) may encircle the key. Preferably, the protective cap (24) may be kept in position by the magnetic attraction of the segmented ring magnet (12), which the cap (24) is intended to protect, to the cap ferrous ring (28). For example, the distance between the segmented ring magnet (12) and the cap ferrous ring (28) can be sufficient to maintain the protective cap (24) in place; yet, be sufficiently weak to permit easy but non-accidental removal by a user. The process of the magnetic key (10) removal from the protective cap (24) is intended to be easy and straightforward as is the replacement of the magnetic key (10) onto the protective cap (24). In some circumstances, the cap may also include a clasp or the like to keep it in place on the key.

Figure 1A:
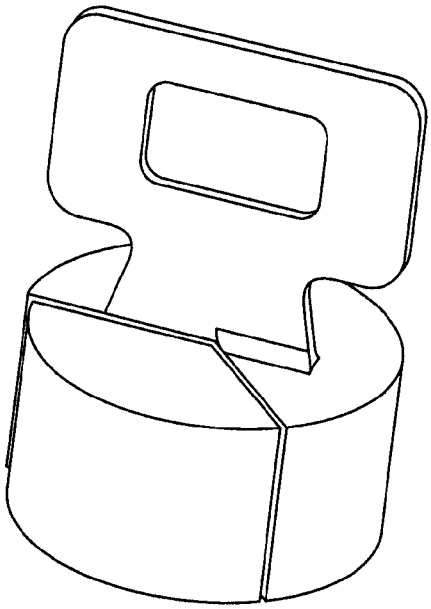
FIG. 1A illustrates a conventional magnetic key.
Figure 1B:
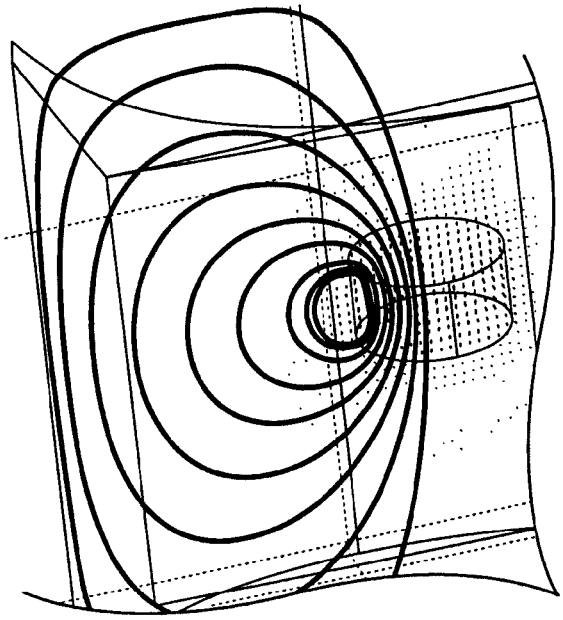
FIG. 1B illustrate the resulting magnetic flux of the conventional magnetic key in FIG. 1A.

Testing has been conducted to determine the resulting magnetic flux lines and vectors in relation to the magnetic key. As a starting point, the prior art magnetic key of FIG. 1A was tested and FIG. 1B illustrate the magnet flux involved and the extent of the magnetic field line for a conventional un-segmented magnet.

Figure 4A:
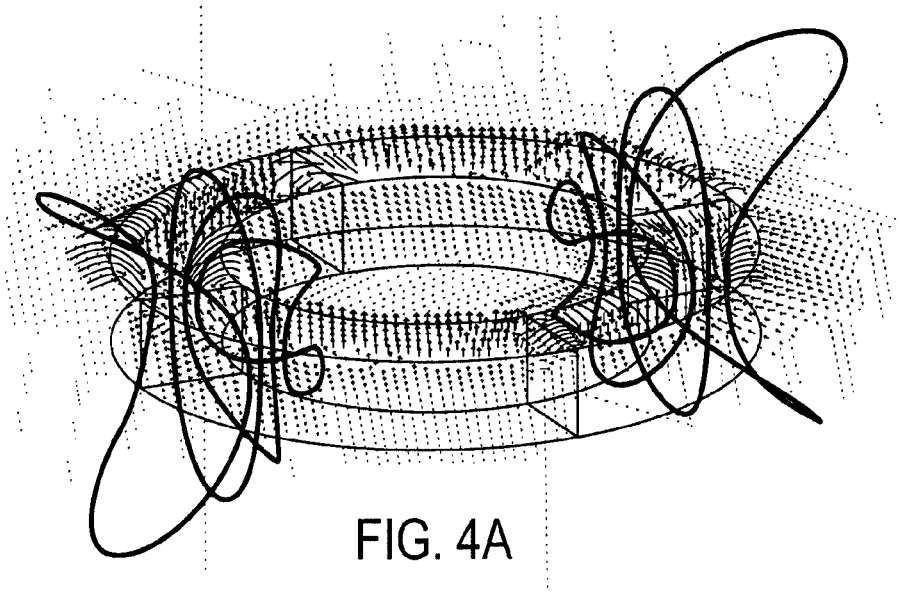
FIG. 4A illustrates a perspective view of magnetic flux vector and flux lines on a segmented 4 pole magnet.
Figure 4B:
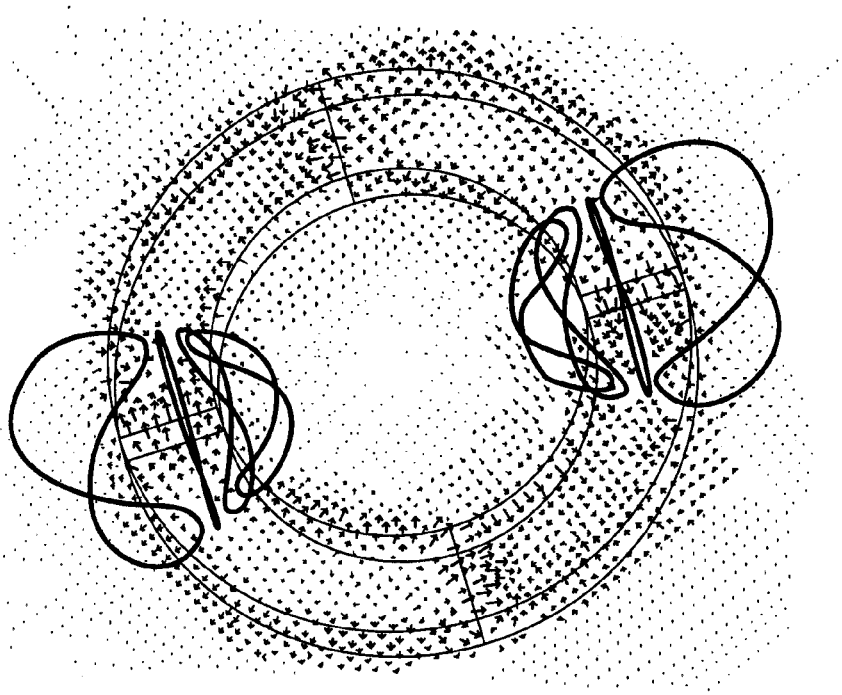
FIG. 4B illustrate a top view of the magnetic flux vector and flux lines of FIG. 4A.

FIGS. 4A and 4B illustrate the magnetic flux vectors and flux lines for a magnetic key with a segmented magnet ring but without the use of a top ferrous ring. FIG. 4A illustrates a perspective view of the segmented magnet ring while FIG. 4B shows a top view. The lines representing equal magnetic flux regions or magnetic field are shown to be limited on a segmented magnet ring with 4 poles even without a top ferrous ring when compared to the lines of equal magnetic flux from the conventional key shown in FIG. 1B. The top view of 4B may better illustrate the limited side magnetic flux extension of the segmented magnet.

Figure 5:
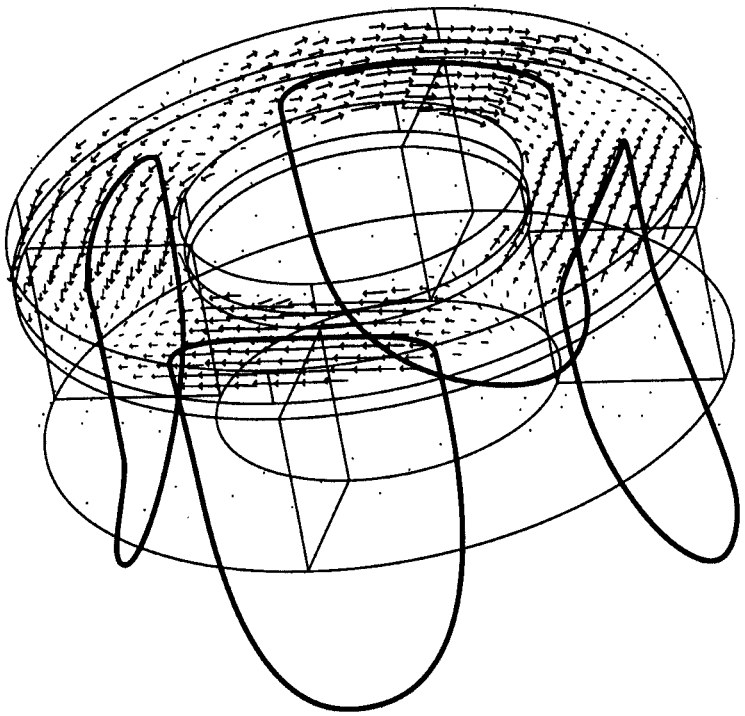
FIG. 5 illustrates flux density lines at a top ferrous ring of the magnetic key in FIG. 2.

FIG. 5 illustrates the magnetic flux lines as well as equal density flux regions or magnetic fields when a segmented magnet key includes a ferrous ring above the segmented magnet in accordance to one embodiment herein. It can be seen that the addition of a top ferrous ring may limit the upward flux lines while the downward magnet flux may not only be targeted at the magnetic button or lock but also may be limited within the protective legs of the magnetic key.

FIG. 6 further illustrates the magnetic flux and regions of equal magnetic field according to an embodiment of the magnetic key containing a ferrous ring above the segmented magnet ring and having the magnetic key positioned within a protective cap further containing a cap matching ferrous ring. FIG. 6 illustrates a closed loop system that may be present in one embodiment of the magnetic key with protective cap. In this embodiment, there may be no outward magnetic force that may cause damage to items sensitive to magnetic fields.

Figure 7A:
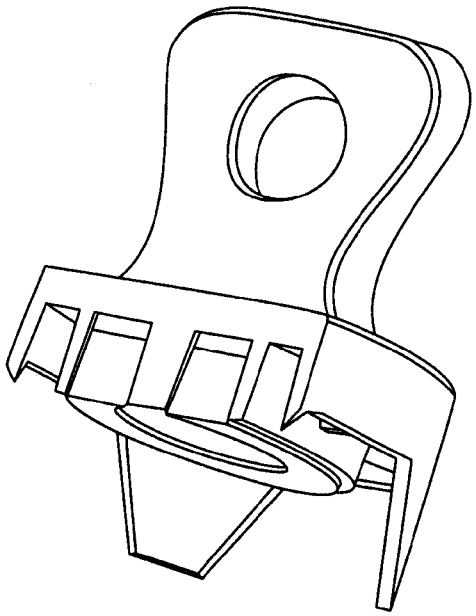
FIG. 7A illustrates a magnetic key according to another embodiment.
Figure 7B:
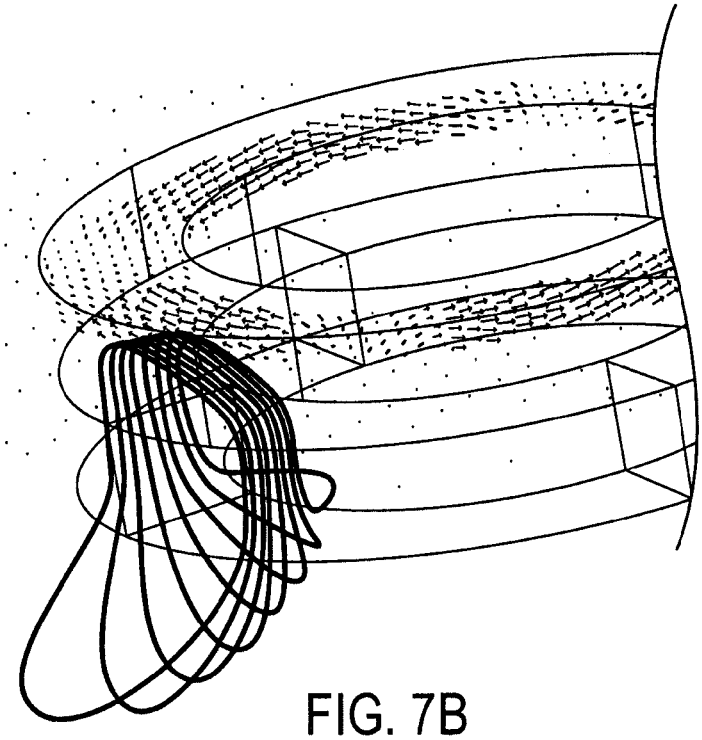
FIG. 7B illustrates the resulting magnetic flux of the magnetic key in FIG. 7A.

FIGS. 7A and 7B illustrate the magnetic key according to one embodiment and the resulting magnetic flux and fields created by that key. FIGS. 8A and 8B show the magnetic key and protective cap according to another embodiment and the resulting magnetic flux and fields created by the key with the protective cap. These figures illustrate the contrast between the magnetic flux and fields created by a conventional key as shown in FIG. 1B and the limited magnetic flux of the magnetic keys according to either embodiment presented above. As is apparent from the figures, the magnetic flux around a magnetic key can be significantly improved based on the embodiments described herein.

The above-described embodiments are intended to be examples only. Those of skill in the art can effect alterations, modifications and variations to the particular embodiments without departing from the scope of this application.

The invention claimed is:

1. A magnetic key comprising:

a body;

a segmented magnet having a magnetic flux and housed within the body, the segmented magnet having a bottom side to face a magnetic lock, and a top side opposite the bottom side; and a magnetic flux limiting ferrous element housed in the body above the segmented magnet facing the top side of the segmented magnet, and configured to substantially block the magnetic flux above and to lateral sides of the segmented magnet and redirect the magnetic flux inward and away from outer edges of the body.

2. The magnetic key of claim 1, wherein the segmented magnet comprises between two and six segments.

3. The magnetic key of claim 1, wherein the segmented magnet comprises between four and six segments.

4. The magnetic key of claim 1, wherein the body further comprises legs extending below the segmented magnet.

5. The magnetic key of claim 4, wherein the magnetic flux limiting ferrous element and ends of the legs are positioned on opposite sides of the segmented magnet.

6. The magnetic key of claim 1, wherein the body further comprises a molded handle.

7. The magnetic key of claim 6, wherein the magnetic flux limiting ferrous element is positioned between the segmented magnet and the handle.

8. The magnetic key of claim 6, wherein the segmented magnet and magnetic flux limiting ferrous element are each ring shaped and are coaxially positioned, wherein the magnetic flux limiting ferrous element is positioned above the segmented magnet along a common axis of the magnetic flux limiting ferrous element and the segmented magnet, and the handle is above the magnetic flux limiting ferrous element along the common axis.

9. The magnetic key of claim 6, wherein the handle comprises a finger aperture.

10. The magnetic key of claim 1, wherein the body is molded of plastic.

11. The magnetic key of claim 1, wherein the segmented magnet is ring shaped.

12. The magnetic key of claim 11, wherein the magnetic flux limiting ferrous element is positioned adjacent the top side of the segmented magnet.

13. The magnetic key of claim 12, wherein the magnetic flux limiting ferrous element is ring shaped and is positioned coaxially with the segmented magnet.

14. The magnetic key of claim 13, wherein the magnetic flux limiting ferrous element contacts a top surface of the segmented magnet.

15. The magnetic key of claim 1, wherein the body defines an active area below the segmented magnet to engage the magnetic lock, the bottom side of the segmented magnet facing the active area.

* * * * *